US007353848B2

(12) United States Patent
Krulitsch

(10) Patent No.: US 7,353,848 B2
(45) Date of Patent: Apr. 8, 2008

(54) BEVERAGE BOTTLING PLANT FOR FILLING BOTTLES WITH A LIQUID BEVERAGE FILLING MATERIAL HAVING A FILLING DEVICE AND A FILLING MACHINE HAVING SUCH A FILLING DEVICE

(75) Inventor: Dieter Rudolf Krulitsch, Bad Kreuznach (DE)

(73) Assignee: KHS Maschinen-und Anlagenbau AG, Dortmund (DE)

( * ) Notice: Subject to any disclaimer, the term of this patent is extended or adjusted under 35 U.S.C. 154(b) by 481 days.

(21) Appl. No.: 11/090,949

(22) Filed: Mar. 25, 2005

(65) Prior Publication Data

US 2005/0217753 A1 Oct. 6, 2005

(30) Foreign Application Priority Data

Mar. 27, 2004 (DE) ..... 10 2004 015 167

(51) Int. Cl.
*B65B 31/00* (2006.01)

(52) U.S. Cl. ..... 141/56; 141/40; 141/44; 141/52; 141/57; 141/146; 141/302

(58) Field of Classification Search ..... 141/4–7, 141/39–40, 44–50, 52, 54, 56, 57, 59, 63, 141/285, 293, 302, 305, 307, 144–147
See application file for complete search history.

(56) References Cited

U.S. PATENT DOCUMENTS 3,155,126 A * 11/1964 Hi ..... 141/50
4,586,548 A * 5/1986 Hinxlage ..... 141/57
5,377,726 A * 1/1995 Clusserath ..... 141/39
5,501,253 A * 3/1996 Weiss ..... 141/40
6,189,578 B1 * 2/2001 Clusserath ..... 141/7

FOREIGN PATENT DOCUMENTS

DE 2 241 064 2/1974
DE 100 64 954 A1 6/2002

* cited by examiner

*Primary Examiner*—Timothy L. Maust
(74) *Attorney, Agent, or Firm*—Nils H. Ljungman & Associates

(57) ABSTRACT

A beverage bottling plant for filling bottles with a liquid beverage filling material having a filling device and a filling machine having such a filling device. The abstract of the disclosure is submitted herewith as required by 37 C.F.R. §1.72(b). As stated in 37 C.F.R. §1.72(b): A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims. Therefore, any statements made relating to the abstract are not intended to limit the claims in any manner and should not be interpreted as limiting the claims in any manner.

20 Claims, 7 Drawing Sheets

BEVERAGE BOTTLING PLANT FOR FILLING BOTTLES WITH A LIQUID BEVERAGE FILLING MATERIAL HAVING A FILLING DEVICE AND A FILLING MACHINE HAVING SUCH A FILLING DEVICE

BACKGROUND

1. Technical Field

The present application relates to a beverage bottling plant for filling bottles with a liquid beverage filling material having a filling device and a filling machine having such a filling device.

2. Background Information

A beverage bottling plant for filling bottles with a liquid beverage filling material can possibly comprise a beverage filling machine with a plurality of beverage filling positions, each beverage filling position having a beverage filling device for filling bottles with liquid beverage filling material. The filling devices may have an apparatus designed to introduce a predetermined volume of liquid beverage filling material into the interior of bottles to a substantially predetermined level of liquid beverage filling material. The apparatus designed to introduce a predetermined flow of liquid beverage filling material further comprises an apparatus that is designed to terminate the filling of the beverage bottles upon the liquid beverage filling material reaching the predetermined level in bottles. There may also be provided a conveyer arrangement that is designed to move bottles, for example, from an inspecting machine to the filling machine. Upon filling, a closing station closes the filled bottles. There may further be provided a conveyer arrangement configured to transfer filled bottles from the filling machine to the closing station. Bottles may be labeled in a labeling station, the labeling station having a conveyer arrangement to receive bottles and to output bottles. The closing station and the labeling station may be connected by a corresponding conveyer arrangement.

The prior art describes a wide variety of filling elements for the filling of bottles or similar containers with a liquid. The prior art includes, among many others, short-tube filling elements for the (short-tube) filling of bottles or similar containers under normal pressure or under counterpressure, and specifically such that the container to be filled is located with the mouth of the container in sealed contact against the filling element, i.e. with the mouth of the container pressed in a sealed position against a gasket that encircles the dispensing opening of the filling element. The dispensing opening thereby surrounds an open tube that projects to some extent beyond the underside of the filling element and during the filling extends into the container opening and functions as a return gas tube, by means of which the gas displaced during the filling process by the incoming liquid is removed from the container, and specifically via at least one gas duct that is controlled by a gas valve.

The prior art also describes filling elements with a short filling tube, and in particular for the contactless or open-jet filling of a container that is located underneath the filling element and is centered in relation to the filling tube, but with its mouth at some distance from the filling element, whereby in this filling method, the liquid being bottled is delivered into the container in the form of an open jet of liquid.

Short-tube filling is suitable in particular for the bottling of soft drink products under counterpressure or at normal pressure. Open-jet filling is suitable in particular for the bottling of biologically sensitive products and is done without dripping and without the mouth of the respective container coming in contact with the filling element, and thus without the risk of bacterial contamination in particular.

Open-jet filling is also preferred for the bottling of products that have a viscosity that is too high for short-tube filling. In this case, too, open-jet bottling has the advantage that the filling takes place without dripping, and specifically without any contact between the mouth of the container and the filling element.

OBJECT OR OBJECTS

The object is to describe a filling device which makes possible, by means of a simple switching operation, both short-tube filling as well as open-jet filling. To accomplish this object, the invention teaches a filling device and a filling machine having such a filling device herein below.

SUMMARY

On the filling element taught by the present application, in the short-tube filling method the tube functions as a return gas tube, and in the open-jet filling method as a filling tube.

It is possible to switch between the two modes of operation, namely short-tube filling and open-jet filling, simply by means of an appropriate actuation of the valves of the filling element. This "switchover" then occurs for all the filling elements of a filling machine at the same time, under the control of the control device that is present or by the selection of an appropriate program. This switching requires no mechanical and/or manual intervention on the filling machine, and in particular it is not necessary to install, remove or replace any parts or components. Nor does this switching require any intervention in a sterile space, which is of great importance especially on filling machines or in bottling plants that are located in a clean room or sterile room for the bottling of particularly sensitive products, and in which sterile conditions must be re-established after a mechanical conversion of a filling machine, which requires a long time and entails a correspondingly long interruption of production.

An additional essential advantage is that all of the ducts and control valves required for both types of operation that are contained inside the respective filling element can be cleaned both by a CIP cleaning performed in the conventional manner and by an external cleaning of a filling machine performed in the conventional manner.

The filling element's ability to operate in both the open jet filling process and the short tube filling process can be advantageous for the beverage bottling industry. Since the embodiments described herein below are designed for both types of filling processes, the components would be standardized and manufacturing costs would decrease. Further, bottle filling companies would not need to spend as much money on filling machine components since the filling element described below operates in both types of filling processes.

The above-discussed embodiments of the present invention will be described further hereinbelow. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The present application is explained in greater detail below on the basis of one exemplary embodiment which is illustrated in the accompanying drawings, in which.

DESCRIPTION OF EMBODIMENT OR EMBODIMENTS

Figure 1:
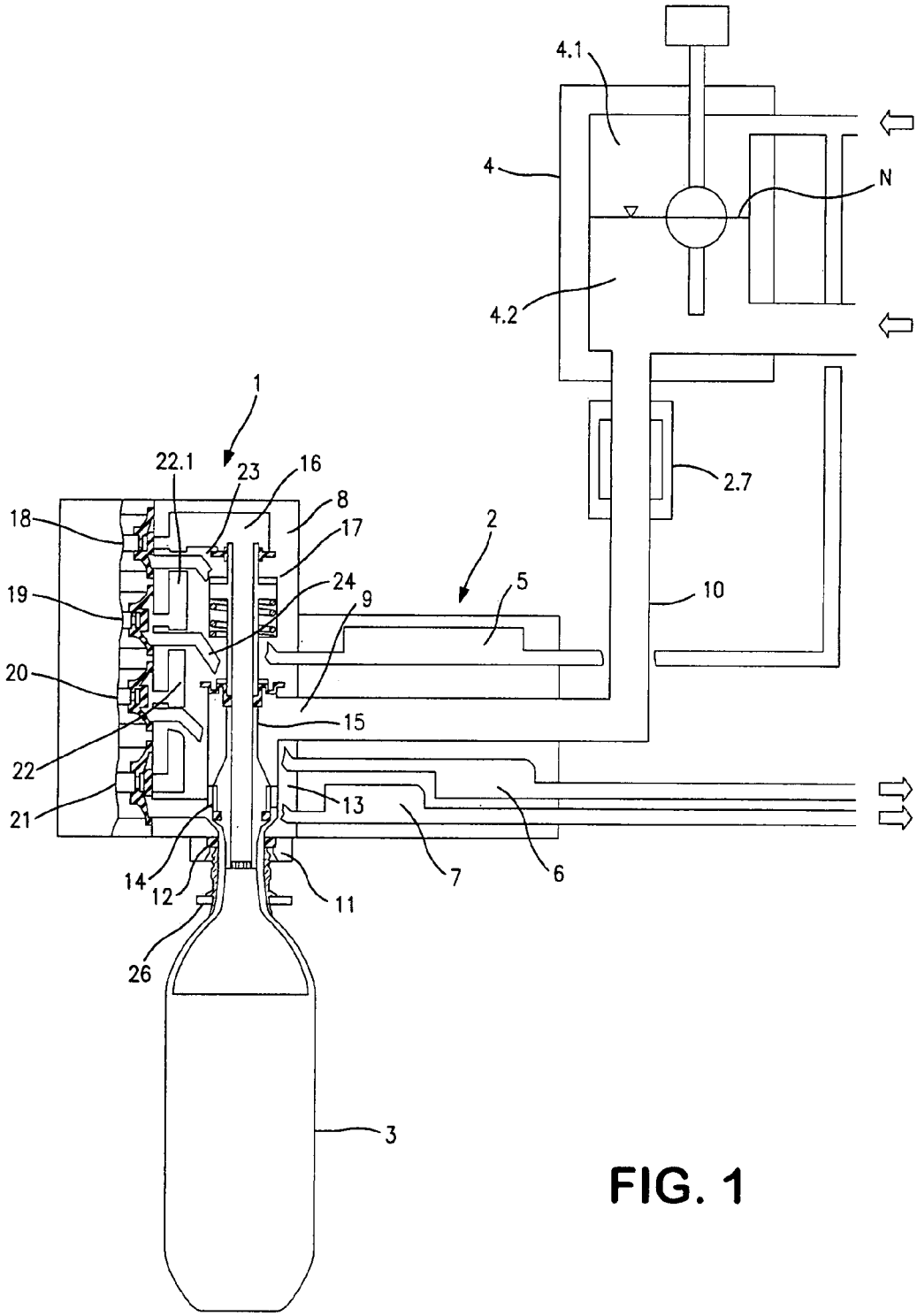
FIG. 1 is a simplified schematic illustration of a filling device or element as claimed by the present application in an operating mode for short-tube or bottle-contact filling, together with a bottle that is pressed in sealed contact against the filling element, and with parts of the rotary-type filling machine that has this filling element.
Figure 1A:
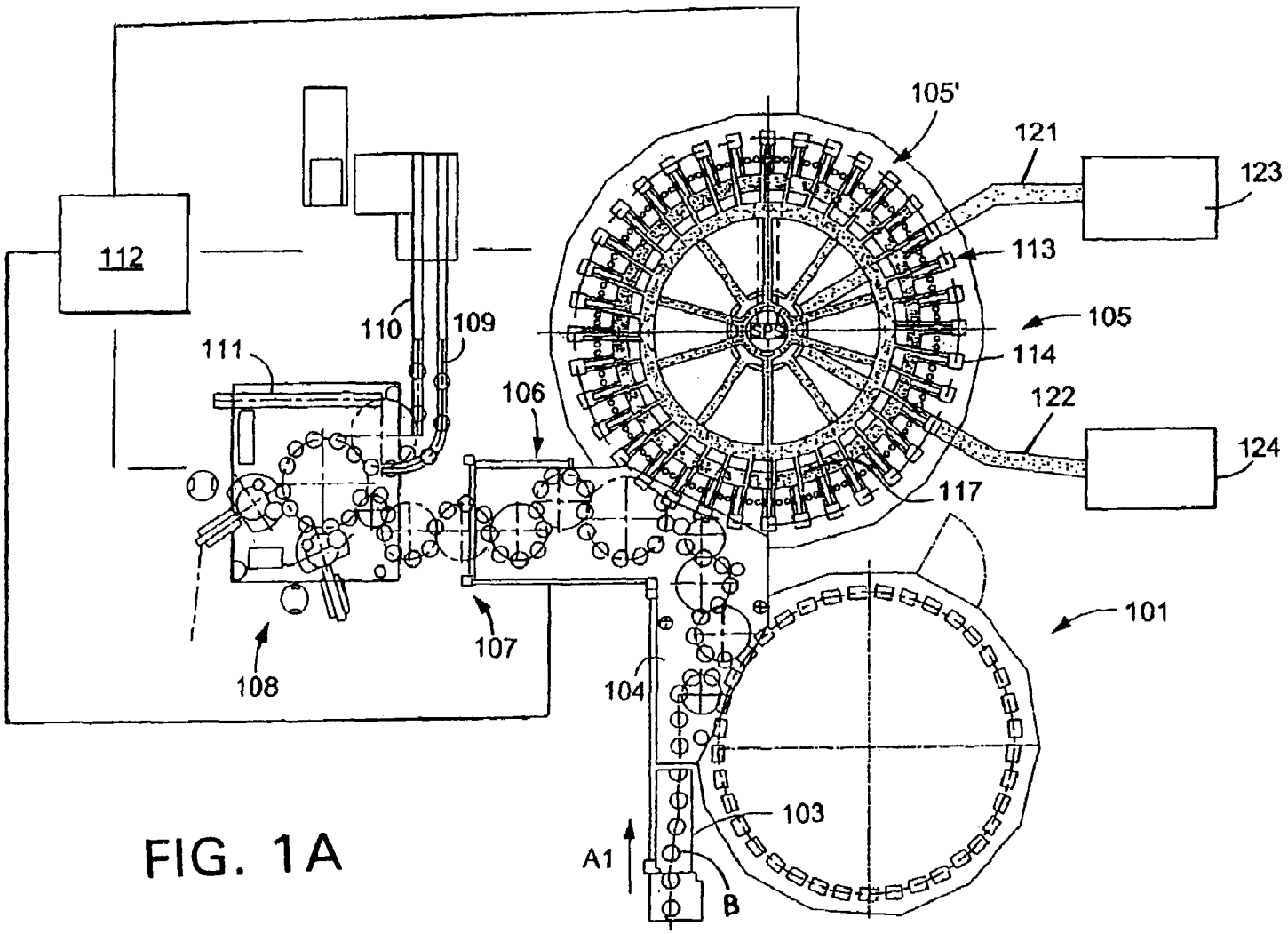
FIG. 1A is a schematic illustration of a container filling plant in accordance with one possible embodiment.

FIG. 1A shows schematically the main components of one possible embodiment example of a system for filling containers, specifically, a beverage bottling plant for filling bottles B with at least one liquid beverage, in accordance with at least one possible embodiment, in which system or plant could possibly be utilized at least one aspect, or several aspects, of the embodiments disclosed herein.

FIG. 1A shows a rinsing arrangement or rinsing station 101, to which the containers, namely bottles B, are fed in the direction of travel as indicated by the arrow A1, by a first conveyer arrangement 103, which can be a linear conveyor or a combination of a linear conveyor and a starwheel. Downstream of the rinsing arrangement or rinsing station 101, in the direction of travel as indicated by the arrow A1, the rinsed bottles B are transported to a beverage filling machine 105 by a second conveyer arrangement 104 that is formed, for example, by one or more starwheels that introduce bottles B into the beverage filling machine 105.

The beverage filling machine 105 shown is of a revolving or rotary design, with a rotor 105', which revolves around a central, vertical machine axis. The rotor 105' is designed to receive and hold the bottles B for filling at a plurality of filling positions 113 located about the periphery of the rotor 105'. At each of the filling positions 103 is located a filling arrangement 114 having at least one filling device, element, apparatus, or valve. The filling arrangements 114 are designed to introduce a predetermined volume or amount of liquid beverage into the interior of the bottles B to a predetermined or desired level.

The filling arrangements 114 receive the liquid beverage material from a toroidal or annular vessel 117, in which a supply of liquid beverage material is stored under pressure by a gas. The toroidal vessel 117 is a component, for example, of the revolving rotor 105'. The toroidal vessel 117 can be connected by means of a rotary coupling or a coupling that permits rotation. The toroidal vessel 117 is also connected to at least one external reservoir or supply of liquid beverage material by a conduit or supply line. In the embodiment shown in FIG. 1A, there are two external supply reservoirs 123 and 124, each of which is configured to store either the same liquid beverage product or different products. These reservoirs 123, 124 are connected to the toroidal or annular vessel 117 by corresponding supply lines, conduits, or arrangements 121 and 122. The external supply reservoirs 123, 124 could be in the form of simple storage tanks, or in the form of liquid beverage product mixers, in at least one possible embodiment.

As well as the more typical filling machines having one toroidal vessel, it is possible that in at least one possible embodiment there could be a second toroidal or annular vessel which contains a second product. In this case, each filling arrangement 114 could be connected by separate connections to each of the two toroidal vessels and have two individually-controllable fluid or control valves, so that in each bottle B, the first product or the second product can be filled by means of an appropriate control of the filling product or fluid valves.

Downstream of the beverage filling machine 105, in the direction of travel of the bottles B, there can be a beverage bottle closing arrangement or closing station 106 which closes or caps the bottles B. The beverage bottle closing arrangement or closing station 106 can be connected by a third conveyer arrangement 107 to a beverage bottle labeling arrangement or labeling station 108. The third conveyor arrangement may be formed, for example, by a plurality of starwheels, or may also include a linear conveyor device.

In the illustrated embodiment, the beverage bottle labeling arrangement or labeling station 108 has at least one labeling unit, device, or module, for applying labels to bottles B. In the embodiment shown, the labeling arrangement 108 has three output conveyer arrangement: a first output conveyer arrangement 109, a second output conveyer arrangement 110, and a third output conveyer arrangement 111, all of which convey filled, closed, and labeled bottles B to different locations.

The first output conveyer arrangement 109, in the embodiment shown, is designed to convey bottles B that are filled with a first type of liquid beverage supplied by, for example, the supply reservoir 123. The second output conveyer arrangement 110, in the embodiment shown, is designed to convey bottles B that are filled with a second type of liquid beverage supplied by, for example, the supply reservoir 124. The third output conveyer arrangement 111, in the embodiment shown, is designed to convey incorrectly labeled bottles B. To further explain, the labeling arrangement 108 can comprise at least one beverage bottle inspection or monitoring device that inspects or monitors the location of labels on the bottles B to determine if the labels have been correctly placed or aligned on the bottles B. The third output conveyer arrangement 111 removes any bottles B which have been incorrectly labeled as determined by the inspecting device.

The beverage bottling plant can be controlled by a central control arrangement 112, which could be, for example, computerized control system that monitors and controls the operation of the various stations and mechanisms of the beverage bottling plant.

In the figures, 1 is a filling device or element in general, which is provided with a plurality of identical filling elements on the periphery of a rotor that is designated 2 schematically in the figures and is driven in rotation around a vertical machine axis and is used to fill a liquid into containers or bottles 3. A ring-bowl 4 is also provided on the rotor 2, and is filled up to a specified level N in a level-controlled mode with the liquid being bottled. In the illustrated exemplary embodiment, on the rotor 2 there are a plurality of annular ducts 5, 6 and 7, of which the annular duct 5 is in communication with, among other things, the interior of the ring bowl 4 above the level of the liquid with the gas headspace 4.1 inside the ring bowl, while the annular ducts 6 and 7 function as pressure relief and vacuum ducts.

In the housing 8 of the filling element 1 the conventional liquid duct 9 is formed, which emerges in its upper portion or at an inlet located in its upper portion by means of a connection 10 into the liquid chamber 4.2 of the ring bowl 4 and on the underside of the housing 8 in the vicinity of a centering bell 11 located at that point at a ring-shaped dispensing opening that is encircled by the gasket of the centering bell 11.

For the controlled dispensing of the liquid to be bottled into the respective bottles 3 being filled, in the liquid duct 9 there is a first liquid valve 13 which comprises essentially a valve body 14 which is provided on the outside surface of a tube 15 that is oriented with its axis in the vertical filling element axis FA. The tube 15 which is open on both ends and can be moved by a limited distance in the direction of the axis FA to open and close the liquid valve 13 projects with its lower, open end slightly beyond the centering bell 11 and extends with its upper end into a chamber 16 that is realized in the housing 8. Between the liquid duct 9 and the chamber 16, there is an actuator element 17 for the controlled opening and closing of the liquid valve 13. In the illustrated embodiment, this actuator element comprises a spring that applies a bias force that moves the liquid valve 13 into the opened position and a cylinder that can be actuated pneumatically, for example, by means of with which the liquid valve 13 is moved into the closed position. By means of appropriate seals, the liquid duct 9 and the chamber 16 are each sealed against the tube at the points where the tube 15 passes through.

On the radial outside with reference to the vertical machine axis, there are four pneumatically actuated control valves 18, 19, 20 and 21 in the housing 8 one above the other in the vertical direction, of which the valves 18-20 are valves that control gas paths during the filling process and the valve 21 is a second liquid valve.

In the interior of the housing 8, a plurality of additional ducts are realized, and specifically a duct 22 which in the illustrated exemplary embodiment extends with a segment 22.1 parallel to the axis FA and emerges with its upper end into the chamber 16 and with its lower end into the liquid duct 9, and specifically into that part of the liquid duct 9 that when the liquid duct 13 is closed is in communication with the connecting duct 10 and/or the ring bowl 4. The second liquid valve 21 is located in the duct 22.

In the illustrated exemplary embodiment, in addition to the duct 22, in the housing 8 there are three gas ducts 23, 24 and 25, each of which is in communication with one of the annular ducts 5, 6 and 7 respectively. The gas duct 23 which is in communication with the ring duct 5 is in communication with the input of the valve 18, the gas duct 24 which is in communication with the ring duct 6 is in communication with the input of the valve 19 and the gas duct 25 which is in communication with the ring duct 7 is in communication with the input of the valve 20. The outputs of these gas valves empty into the segment 22.1 of the duct 22 that extends between the chamber 16 and the liquid valve 21.

Figure 2:
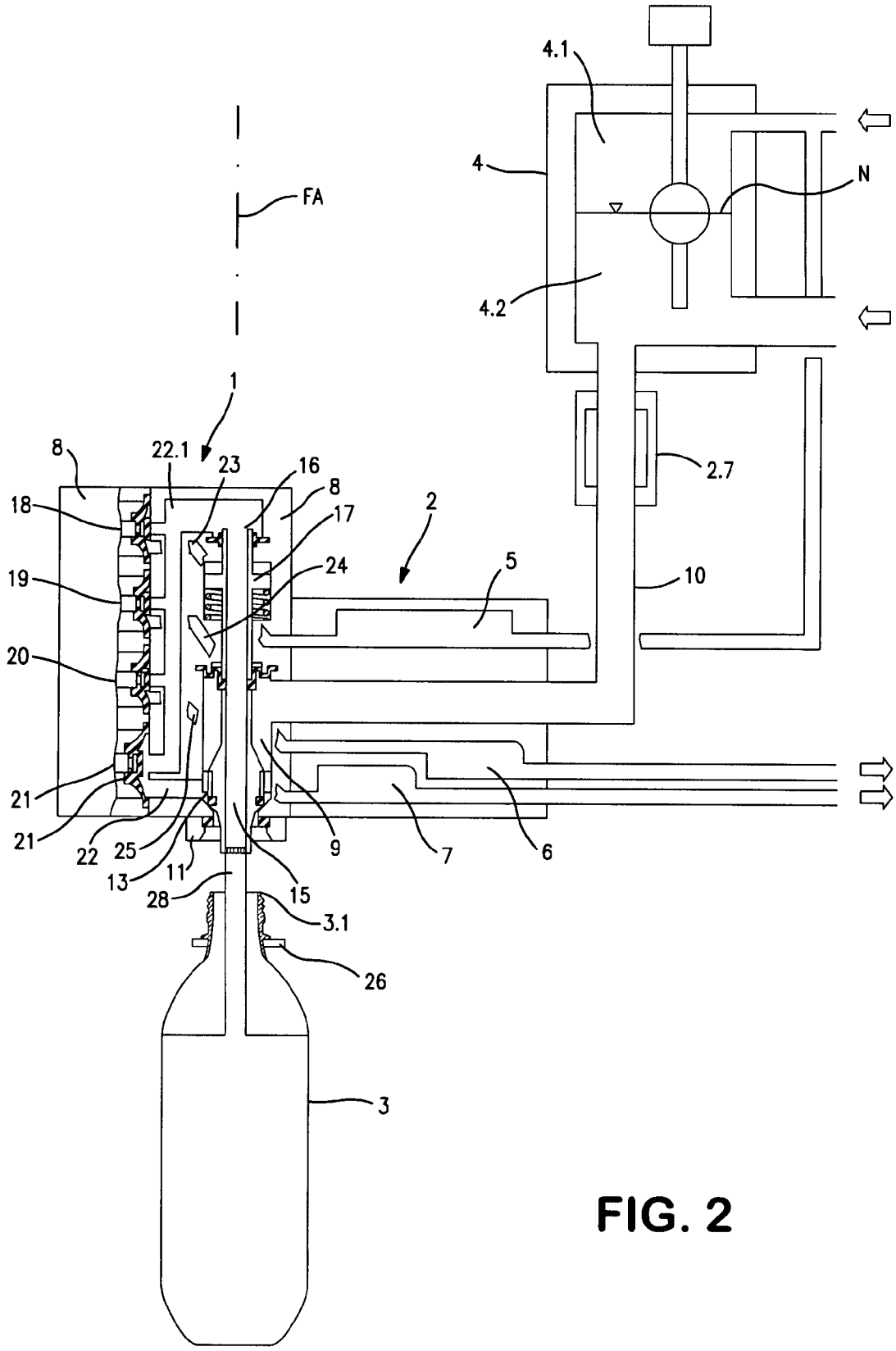
FIG. 2 is an illustration similar to FIG. 1, but in an operating mode of the filling device for open-jet filling, with the bottle at some distance from the filling device.

As FIGS. 1 and 2 show, optionally either a short-tube or bottle-contact filling (FIG. 1) or an open-jet filling of the bottles 3 is possible with the filling element 1.

For short-tube filling—illustrated in FIG. 1—the respective bottle 3 is pressed by means of a bottle carrier 26 that is provided on each filling element 1, whereby said carrier 26 engages a flange on the bottle 3 that projects from the neck of the bottle, with its bottle mouth 3.1 (FIG. 2) in sealed contact against the filling element 1 or against the gasket of the centering bell 11. Before the actual filling takes place under counterpressure, in any case there is a pre-pressurization of the bottle 3 with compressed gas (inert gas) from the gas headspace 4.1, and specifically with the valve 18 open. For the actual filling, then, while the bottle 3 is still in sealed contact against the filling element 1, the liquid valve 13 is opened, so that by means of the ring-shaped discharge opening 12 that encircles the tube 15, the liquid being bottled flows into the bottle 3 and the inert gas that is thereby displaced by the liquid from the bottle 3 flows back via the tube 15 that functions as the return gas tube into the chamber 16 and from there, for example, via the open valve 18, through the gas duct 23 and via the ring duct 5 into the gas headspace 4.1 of the ring bowl.

Controlled by an inductive flow-meter 27 in the connecting duct 13, the liquid valve 13 is again closed at the conclusion of the actual filling phase.

Figure 1B:
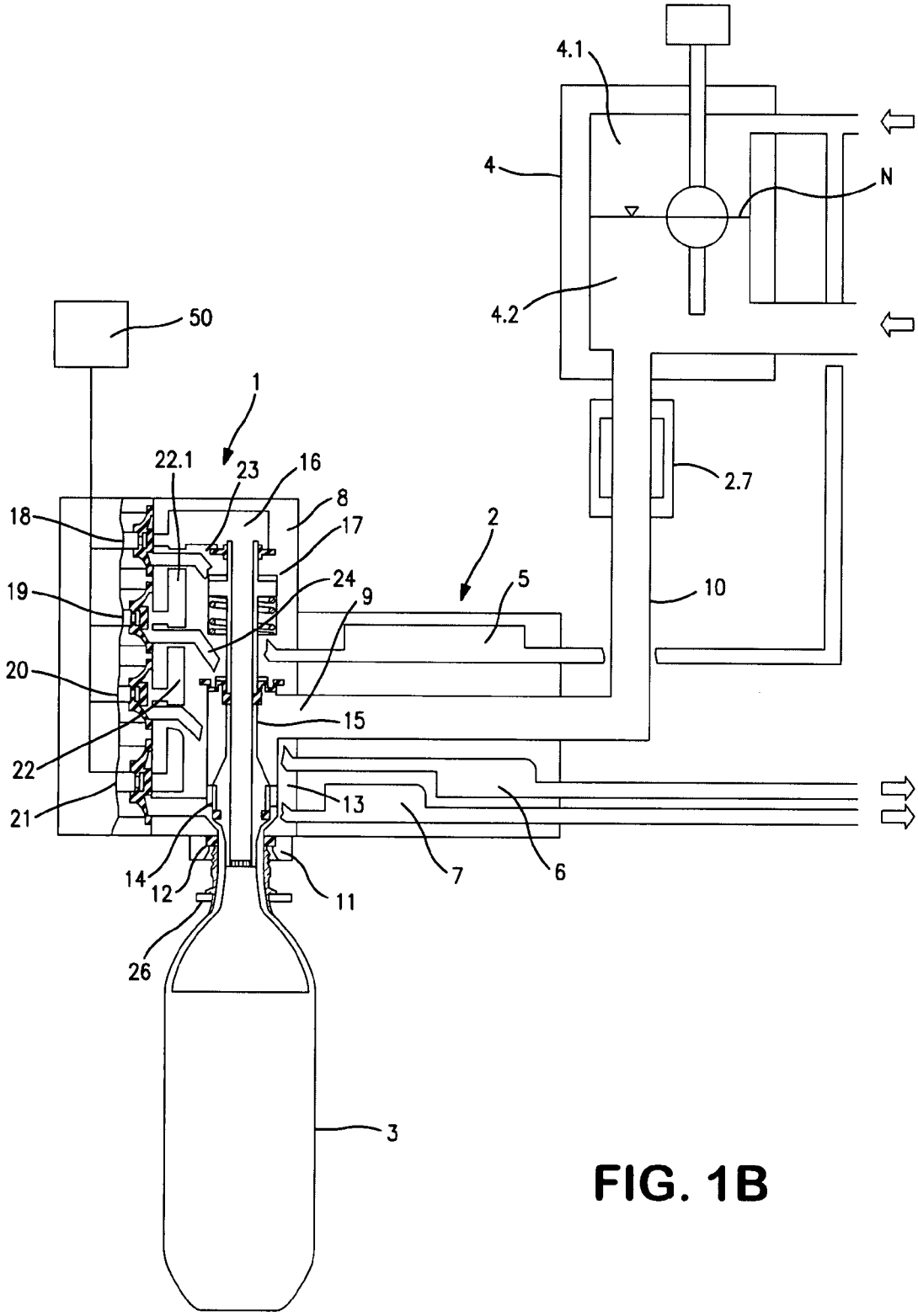
FIG. 1B is another possible embodiment of the filling device shown in FIG. 1.

FIG. 1B is similar to FIG. 1, and shows another possible embodiment of a filling element. In this possible embodiment, the valves 18, 19, 20, and 21 are connected to a control mechanism 50, which control mechanism 50 is configured to open and close the valves to control the flow of gas and liquid through the filling element.

Other filling methods and process sequences, e.g. for flushing the bottles 3 when the bottles 3 are in the sealed connection with the filling element 3 and using the tube 15 as a return gas tube are also possible, such as filling under normal pressure, for example.

FIG. 2 shows the use of the filling element 1 in a filling process in which the tube 15 is not used as the return gas tube but as a short filling tube, and specifically for the open-jet filling of the bottles 3. The bottle 3 to be filled is in this case held on the container carrier 26 so that it is located with its bottle mouth 3.1 at some distance below the filling element 1, and specifically so that the vertical axis of the bottle is equiaxial with the axis FA.

To initiate the filling process, with the closed liquid valve 13, the additional liquid valve is opened so that the liquid to be bottled flows out of the ring bowl 4 via the connecting duct 10, the liquid duct 9 and the duct 22 into the chamber 16, and from there via the tube 15 in the form of an open liquid jet 28 into the waiting bottle 3. The gas that is displaced from the bottle during the filling process escapes into the open space through the open mouth of the bottle. In this realization, the liquid valve 21 is also closed in a controlled manner by the signal from the inductive flow-meter 27.

Figure 3:
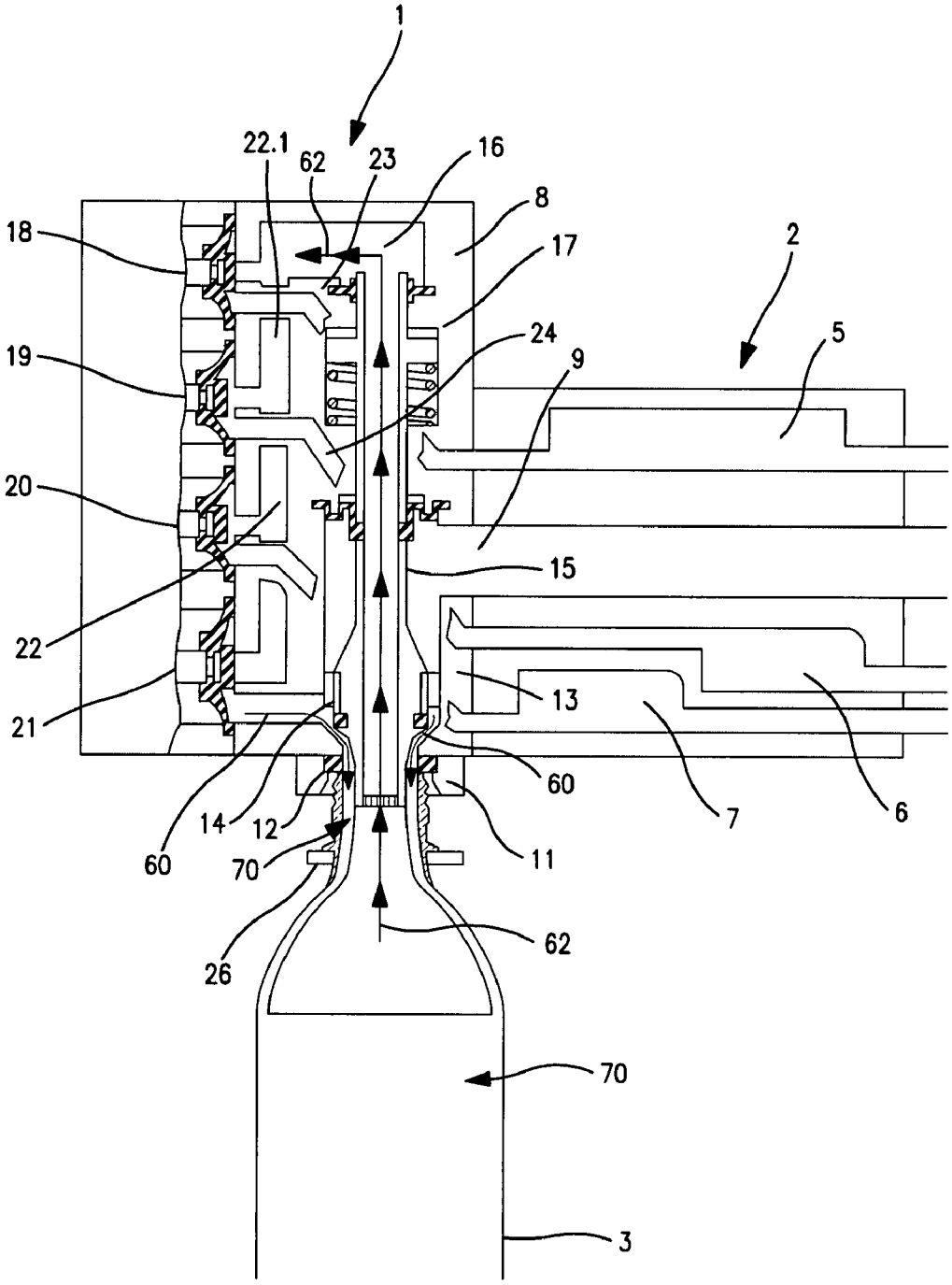
FIG. 3 is a blown up version of the embodiment shown in FIG. 1 showing more details.

FIG. 3 is a close-up view of the embodiment shown in FIG. 1. During the filling process wherein a bottle makes a sealed contact with the filling element, the valve 13 is open to permit a liquid beverage 70 to flow in a downward direction 60 into a bottle to be filled. The tube 15 acts as a gas return tube, permitting gas to escape in an upward path 62 from a bottle being filled and toward the gas valves 18, 19, and 20. The gas is then directed to the gas ducts 23, 24, and 25, then into the gas headspace 4.1 of the ring bowl via the ring duct 5.

Figure 4:
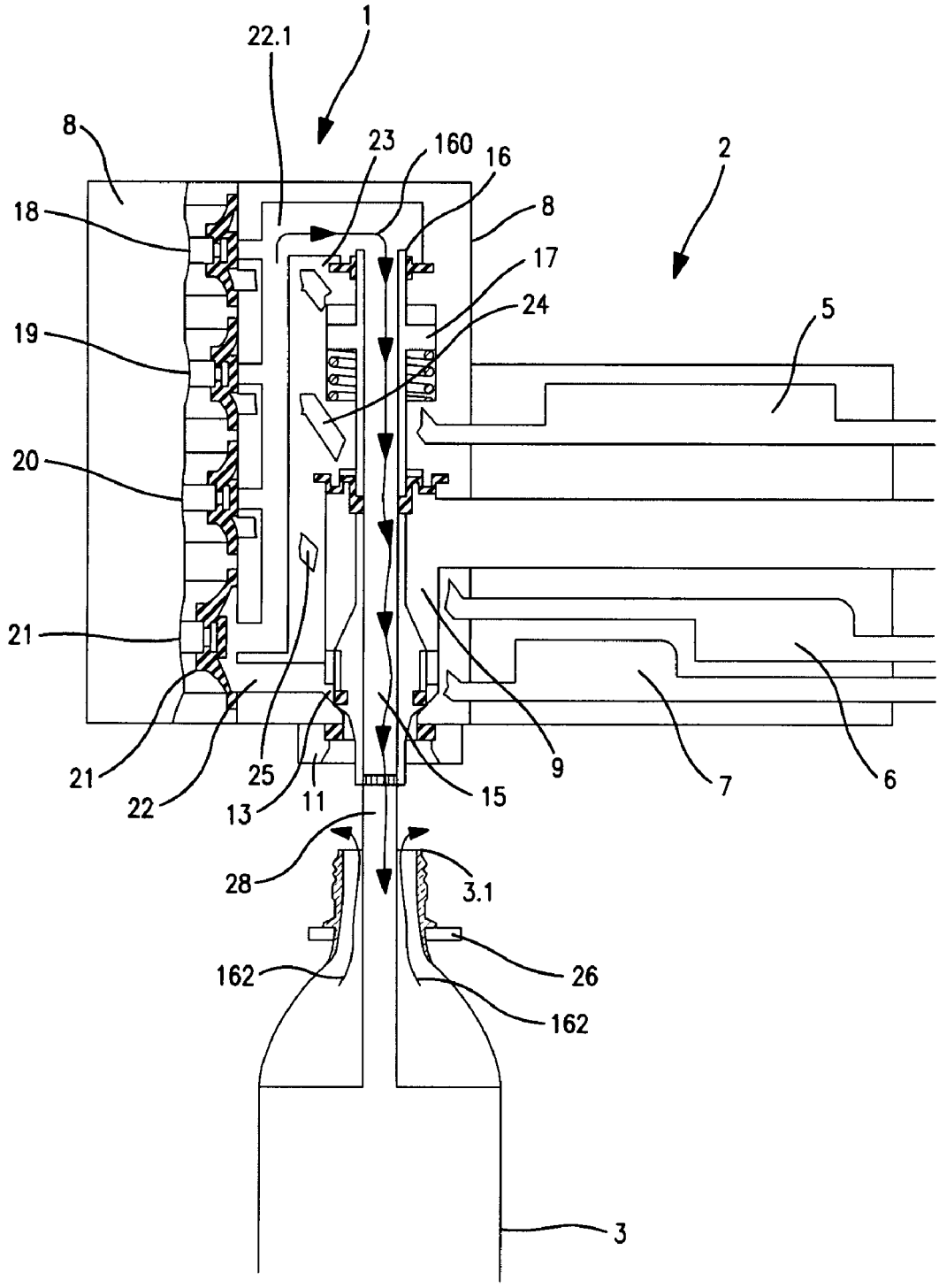
FIG. 4 is a blown up version of the embodiment shown in FIG. 2 showing more details.

FIG. 4 is a close-up view of the embodiment shown in FIG. 2. During the open jet filling process when a bottle is disposed at some distance below the filling element, the liquid valve 13 and the gas valves 18, 19, and 20 are closed, while the second liquid valve 21 is open. Liquid beverage flows out of the ring bowl 4 via the connecting duct 10, the liquid duct 9 and the duct 22 into the chamber 16. The liquid beverage then flows from the chamber 16 via the tube 15 in a downward direction 160 in the form of an open liquid jet 28 and into a bottle 3. During the open jet filling process, gas escapes from the bottle being filled in the direction 162 from the sides of the open bottle mouth.

Figure 5:
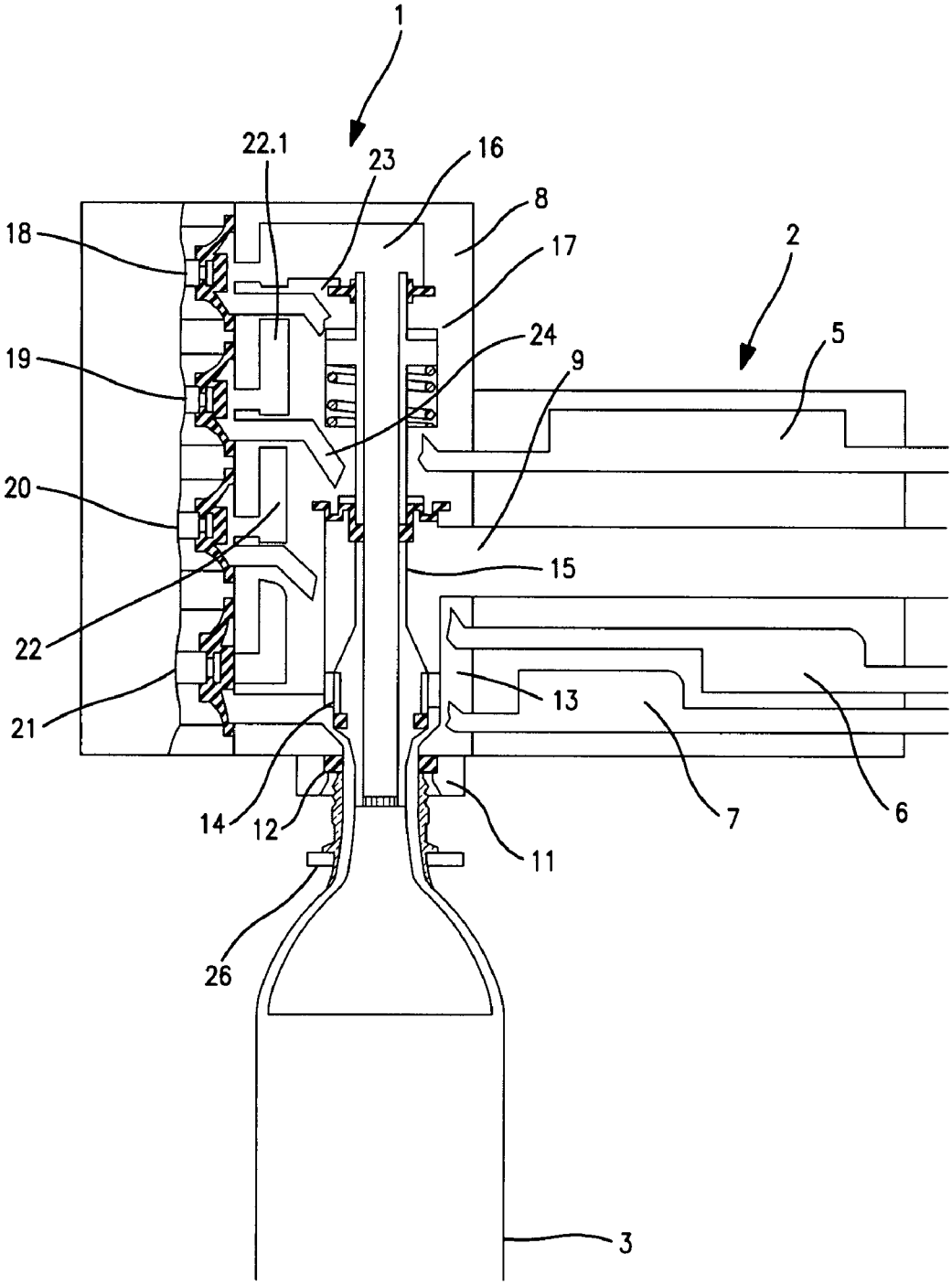
FIG. 5 is another view of the filling device shown in FIG. 1.

FIG. 5 shows another view of the filling element shown in FIG. 1. In this embodiment, the gas valve 18 is open during the filling process where a bottle being filled is in sealed contact with the filling element.

The above figures show a number of different configurations of opened and closed valves. It should be noted that any number of configurations of opened and closed valves may be possible in different embodiments of the filling element. Other possible embodiments may require one or more gas valves to be opened or closed during the filling process, and/or one or more liquid valves to be opened or closed during the filling process.

The present application is described above on the basis of one exemplary embodiment. It goes without saying that variations and modifications can be made to the embodiments without thereby going beyond the teaching of the present application.

The present application relates to a filling element with an open tube in the vicinity of a dispensing opening for a liquid to be bottled can be used optionally for short-tube filling, in which the tube functions as the return gas tube, or for open-jet filling, in which the tube functions as a short filling tube.

One feature or aspect of an embodiment is believed at the time of the filing of this patent application to possibly reside broadly in a beverage bottling plant for filling beverage bottles with liquid beverage material, said beverage bottling plant comprising: a beverage bottle cleaning machine being configured and disposed to clean beverage bottles; a feed arrangement to supply beverage bottles to said beverage bottle cleaning machine; a beverage filling machine being configured and disposed to fill beverage bottles with liquid beverage material; said beverage filling machine comprising a plurality of beverage filling devices for filling beverage bottles with liquid beverage material; at least one storage unit being configured and disposed to store a supply of liquid beverage material; at least one supply line being configured and disposed to connect said at least one storage unit to said beverage filling machine to supply liquid beverage material to said beverage filling machine; a first conveyer arrangement being configured and disposed to move beverage bottles from said beverage bottle cleaning machine into said beverage filling machine; said first conveyer arrangement comprising a star wheel structure; a beverage bottle closing machine being configured and disposed to close tops of filled beverage bottles; a second conveyer arrangement being configured and disposed to move filled beverage bottles from said beverage filling machine into said beverage bottle closing machine; said second conveyer arrangement comprising a star wheel structure; a beverage bottle labeling machine being configured and disposed to label filled, closed beverage bottles; a third conveyor arrangement being configured and disposed to move filled, closed beverage bottles from said beverage bottle closing machine into said beverage bottle labeling machine; said third conveyer arrangement comprising a star wheel structure; a beverage bottle packing station being configured and disposed to package labeled, filled, closed beverage bottles; a fourth conveyor arrangement being configured and disposed to move labeled, filled, closed beverage bottles from said beverage bottle labeling machine to said beverage bottle packing station; said fourth conveyer arrangement comprising a linear conveyor structure being configured and disposed to arrange beverage bottles in groups for packing; said beverage filling machine comprising a rotor being configured and disposed to carry said plurality of filling devices about its periphery; each of said filling devices comprising: a dispensing opening being configured and disposed to permit the flow of liquid through said dispensing opening and into a bottle to be filled; a liquid duct being configured and disposed to permit the flow of liquid from a liquid reservoir; a housing being configured and disposed to house said liquid duct; a first liquid valve being disposed in said liquid duct to control the flow of liquid to said dispensing opening; a first valve actuating arrangement being configured and disposed to open and close said first liquid valve; a tube comprising an open top end portion and an open bottom end portion; said tube being configured and disposed to permit the flow of a liquid beverage into a bottle to be filled in an open-jet filling process; said tube being configured and disposed to permit the flow of gas out of a bottle being filled in a bottle-contact filling process; at least one gas valve being configured and disposed to be opened and closed with an actuating device and to control the flow of gas from said tube in a bottle-contact filling process; at least one gas duct being configured and disposed to carry gas from said filling device in a bottle-contact filling process; a second liquid valve being configured and disposed to be closed with an actuating device to stop a liquid beverage from flowing into said tube in a bottle-contact filling process; and said second liquid valve being configured and disposed to be opened with an actuating device to permit the flow of liquid beverage into said tube in an open-jet filling process.

Another feature or aspect of an embodiment is believed at the time of the filing of this patent application to possibly reside broadly in a filling device in a beverage bottling plant, said filling device comprising: a tube comprising an open top end portion and an open bottom end portion; said tube being configured and disposed to permit the flow of a liquid beverage into a bottle in an open-jet filling process; said tube being configured and disposed to permit gas to be evacuated from a bottle during a bottle-contact filling process; liquid valving being configured and disposed to lead a liquid beverage into said open top end of said tube and to discharge a liquid beverage from said open bottom end of said tube during an open-jet filling process; gas valving being configured and disposed to permit gas to be evacuated from a bottle via said tube in a bottle-contact filling process; and liquid valving being configured and disposed to permit liquid to flow into a bottle during a bottle-contact filling process.

A further feature or aspect of an embodiment is believed at the time of the filing of this patent application to possibly reside broadly in a method of filling bottles with a liquid beverage with a filling device, said filling device comprising: a tube comprising an open top end portion and an open bottom end portion; said tube being configured and disposed to permit the flow of a liquid beverage into a bottle in an open-jet filling process; said tube being configured and disposed to permit gas to be evacuated from a bottle during a bottle-contact filling process; liquid valving being configured and disposed to lead a liquid beverage into said open top end of said tube and to discharge a liquid beverage from said open bottom end of said tube during an open-jet filling process; gas valving being configured and disposed to permit gas to be evacuated from a bottle via said tube in a bottle-contact filling process; and liquid valving being configured and disposed to permit liquid to flow into a bottle during a bottle-contact filling process said method comprising the steps of: operating said liquid valving to permit a liquid beverage to flow through said tube; leading a liquid beverage down said tube and into a bottle in an open-jet filling process; evacuating gas from a bottle being filled through said tube during a bottle-contact filling process; operating said gas valving to permit gas to be evacuated from said filling device; and permitting liquid to flow through said valving to fill a bottle in a bottle-contact filling process.

Another feature or aspect of an embodiment is believed at the time of the filing of this patent application to possibly reside broadly in a filling element for bottling a liquid in bottles or similar containers, with a liquid duct realized in a housing of the filling element, which liquid duct is in communication by means of an inlet with a reservoir or bowl for the liquid being bottled and forms a dispensing opening for the dispensing of the liquid into a container to be filled, with a first liquid valve with an associated actuator device located between the inlet and the dispensing opening in the liquid duct for the controlled opening and closing of the first liquid valve, with a tube which is open on both ends and is provided with a first open end in the vicinity of the dispensing opening, with a plurality of ducts that are realized in the housing of the filling element, and with control valves controlling said ducts, whereby to fill the respective container that is positioned in sealed contact with the filling element, at least one of the control valves controls a return gas duct that leads through the tube, characterized by the fact that in addition to the first liquid valve, a control valve that functions as an additional liquid valve is provided, by means of which, for an open-jet filling of the respective container with its mouth at some distance from the filling element, the second end of the tube can be placed in communication in a controlled manner with the reservoir or bowl that contains the liquid to be bottled.

Another feature or aspect of an embodiment is believed at the time of the filing of this patent application to possibly reside broadly in a filling element, characterized by the fact that the control valve that forms said additional liquid valve is located in a connecting duct between the second end of the tube and a portion of the liquid duct that extends between the inlet for the liquid into the filling element and the first liquid valve.

Yet another feature or aspect of an embodiment is believed at the time of the filing of this patent application to possibly reside broadly in a filling element, characterized by the fact that the connecting duct is in communication on one end with the second end of the tube.

Still another feature or aspect of an embodiment is believed at the time of the filing of this patent application to possibly reside broadly in a filling element, characterized by the fact that the connecting duct and the tube empty into a common chamber that is realized in the housing.

A further feature or aspect of an embodiment is believed at the time of the filing of this patent application to possibly reside broadly in a filling element, characterized by the fact that the at least one gas valve is located in a connection between a gas duct and a segment of the connecting duct that is in communication with the tube.

Another feature or aspect of an embodiment is believed at the time of the filing of this patent application to possibly reside broadly in a filling element, characterized by the fact that the tube is surrounded in a ring-like manner on its first end by the dispensing opening.

Yet another feature or aspect of an embodiment is believed at the time of the filing of this patent application to possibly reside broadly in a filling element, characterized by the fact that the tube projects out of the filling element beyond a contact surface that is formed on the dispensing opening for the mouth of the respective container.

Still another feature or aspect of an embodiment is believed at the time of the filing of this patent application to possibly reside broadly in a filling element, characterized by the fact that the first liquid valve is formed by a valve body that is provided on the tube and interacts with a valve surface in the liquid duct, and that the tube can be moved over axially over a limited distance together with the valve body for the opening and closing of the first liquid valve by the actuator device of said valve.

A further feature or aspect of an embodiment is believed at the time of the filing of this patent application to possibly reside broadly in a filling element, characterized by at least three gas ducts realized in the housing, with respective gas valves that each control one of said ducts.

Another feature or aspect of an embodiment is believed at the time of the filing of this patent application to possibly reside broadly in a filling element, characterized by the fact that each of the gas ducts can be placed in communication in a controlled manner by means of their control valves with the segment of the connecting duct that is in communication with the one end of the tube.

Yet another feature or aspect of an embodiment is believed at the time of the filing of this patent application to possibly reside broadly in a filling machine with a rotary construction for the filling of bottles or similar containers with a liquid to be bottled, characterized by the fact that on the periphery of a rotor that can be driven in rotation around a vertical machine axis, a plurality of filling elements are located.

The components disclosed in the various publications, disclosed or incorporated by reference herein, may possibly be used in possible embodiments of the present invention, as well as equivalents thereof.

Some examples of bottling systems, which may be used or adapted for use in at least one possible embodiment of the present may be found in the following U.S. Patents assigned to the Assignee herein, namely: U.S. Pat. No. 4,911,285; U.S. Pat. No. 4,944,830; U.S. Pat. No. 4,950,350; U.S. Pat. No. 4,976,803; U.S. Pat. No. 4,981,547; U.S. Pat. No. 5,004,518; U.S. Pat. No. 5,017,261; U.S. Pat. No. 5,062,917; U.S. Pat. No. 5,062,918; U.S. Pat. No. 5,075,123; U.S. Pat. No. 5,078,826; U.S. Pat. No. 5,087,317; U.S. Pat. No. 5,110,402; U.S. Pat. No. 5,129,984; U.S. Pat. No. 5,167,755; U.S. Pat. No. 5,174,851; U.S. Pat. No. 5,185,053; U.S. Pat. No. 5,217,538; U.S. Pat. No. 5,227,005; U.S. Pat. No. 5,413,153; U.S. Pat. No. 5,558,138; U.S. Pat. No. 5,634,500; U.S. Pat. No. 5,713,403; U.S. Pat. No. 6,276,113; U.S. Pat. No. 6,213,169; U.S. Pat. No. 6,189,578; U.S. Pat. No. 6,192,946; U.S. Pat. No. 6,374,575; U.S. Pat. No. 6,365,054; U.S. Pat. No. 6,619,016; U.S. Pat. No. 6,474,368; U.S. Pat. No. 6,494,238; U.S. Pat. No. 6,470,922; and U.S. Pat. No. 6,463,964.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

Some examples of filling machines that utilize electronic control devices to control various portions of a filling or bottling process and that may possibly be utilized or possibly adapted for use in at least one possible embodiment of the present application may possibly be found in the following U.S. Pat. No. 4,821,921 issued to Cartwright et al. on Apr. 18, 1989; U.S. Pat. No. 5,056,511 issued to Ronge on Oct. 15, 1991; U.S. Pat. No. 5,273,082 issued to Paasche et al. on Dec. 28, 1993; and U.S. Pat. No. 5,301,488 issued to Ruhl et al. on Apr. 12, 1994.

The appended drawings in their entirety, including all dimensions, proportions and/or shapes in at least one embodiment of the invention, are accurate and are hereby included by reference into this specification.

Some examples of stepping motors that may possibly be utilized or possibly adapted for use in at least one possible embodiment of the present application may possibly be found in the following U.S. Pat. No. 6,348,774 issued to Andersen et al. on Feb. 19, 2002; U.S. Pat. No. 6,373,209 issued to Gerber et al. on Apr. 16, 2002; U.S. Pat. No. 6,424,061 issued to Fukuda et al. on Jul. 23, 2002; U.S. Pat. No. 6,509,663 issued to Aoun on Jan. 21, 2003; U.S. Pat. No. 6,548,923 to Ohnishi et al. on Apr. 15, 2003; and U.S. Pat. No. 6,661,193 issued to Tsai on Dec. 9, 2003.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

Some examples of servo-motors that may possibly be utilized or possibly adapted for use in at least one possible embodiment of the present application may possibly be found in the following U.S. patents: U.S. Pat. No. 4,050,434 issued to Zbikowski et al. on Sep. 27, 1977; U.S. Pat. No. 4,365,538 issued to Andoh on Dec. 28, 1982; U.S. Pat. No. 4,550,626 issued to Brouter on Nov. 5, 1985; U.S. Pat. No. 4,760,699 issued to Jacobsen et al. on Aug. 2, 1988; U.S. Pat. No. 5,076,568 issued to de Jong et al. on Dec. 31, 1991; and U.S. Pat. No. 6,025 issued to Yasui on Feb. 15, 2000.

All, or substantially all, of the components and methods of the various embodiments may be used with at least one embodiment or all of the embodiments, if more than one embodiment is described herein.

Some examples of synchronous motors which may possibly be utilized or adapted for use in at least one possible embodiment may possibly be found in the following U.S. Pat. No. 6,713,899, entitled "Linear synchronous motor;" U.S. Pat. No. 6,486,581, entitled "Interior permanent magnet synchronous motor;" U.S. Pat. No. 6,424,114, entitled "Synchronous motor;" U.S. Pat. No. 6,388,353, entitled "Elongated permanent magnet synchronous motor;" U.S. Pat. No. 6,329,728, entitled "Cylinder-type linear synchronous motor;" U.S. Pat. No. 6,025,659, entitled "Synchronous motor with movable part having permanent magnets;" U.S. Pat. No. 5,936,322, entitled "Permanent magnet type synchronous motor;" and U.S. Pat. No. 5,448,123, entitled "Electric synchronous motor."

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

Some examples of filling machine cleaning methods and apparatus that may possibly be utilized or possibly adapted for use in at least one possible embodiment of the present application may possibly be found in the following patent publications: U.S. Pat. No. 3,964,526 issued to Sindermann on Jun. 22, 1976; U.S. Pat. No. 5,173,259 issued to Bordini on Dec. 22, 1992; U.S. Pat. No. 5,558,138 issued to Stock et al. on Sep. 24, 1996; German Patent No. DE-PS 30 17 197 issued on Jan. 2, 1987; German Laid Open Patent Application No. 39 27 401 published on Feb. 21, 1991; German Laid Open Patent Application No. 41 09 731 published on Oct. 31, 1991; and European Patent No. 0 644 152 published on Mar. 22, 1995.

All of the patents, patent applications and publications recited herein, and in the Declaration attached hereto, are hereby incorporated by reference as if set forth in their entirety herein.

Some examples of computer systems that may possibly be utilized or possibly adapted for use in at least one possible embodiment of the present application may possibly be found in the following U.S. Pat. No. 5,416,480 issued to Roach et al. on May 16, 1995; U.S. Pat. No. 5,479,355 issued to Hyduke on Dec. 26, 1995; U.S. Pat. No. 5,481,730 issued to Brown et al. on Jan. 2, 1996; U.S. Pat. No. 5,805,094 issued to Roach et al. on Sep. 8, 1998; U.S. Pat. No. 5,881,227 issued to Atkinson et al. on Mar. 9, 1999; and U.S. Pat. No. 6,072,462 issued to Moshovich on Jun. 6, 2000.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

Some examples of control valve apparatus that may possibly be utilized or possibly adapted for use in at least one possible embodiment of the present application may possibly be found in the following U.S. Pat. No. 5,406,975 issued to Nakamichi et al. on Apr. 18, 1995; U.S. Pat. No. 5,503,184 issued to Reinartz et al. on Apr. 2, 1996; U.S. Pat. No. 5,706,849 issued to Uchida et al. on Jan. 13, 1998; U.S. Pat. No. 5,975,115 issued to Schwegler et al. on Nov. 2, 1999; U.S. Pat. No. 6,142,445 issued to Kawaguchi et al. on Nov. 7, 2000; and U.S. Pat. No. 6,145,538 issued to Park on Nov. 14, 2000.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

Some examples of pneumatic arrangements that may possibly be utilized or possibly adapted for use in at least one possible embodiment of the present application may possibly be found in the following U.S. Pat. No. 6,609,767 issued to Mortenson et al. on Aug. 26, 2003; U.S. Pat. No. 6,632,072 issued to Lipscomb et al. on Oct. 14, 2003; U.S. Pat. No. 6,637,838 issued to Watanabe on Oct. 28, 2003; U.S. Pat. No. 6,659,693 issued to Perkins et al. on Dec. 9, 2003; U.S. Pat. No. 6,668,848 issued to Ladler et al. on Dec. 30, 2003; and U.S. Pat. No. 6,676,229 issued to Marra et al. on Jan. 13, 2004.

The corresponding foreign and international patent publication applications, namely, Federal Republic of Germany Patent Application No. 10 2004 015 167.9, filed on Mar. 27, 2004, having inventor Dieter Rudolf Krulitsch, and DE-OS 10 2004 015 167.9 and DE-PS 10 2004 015 167.9, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

Some examples of nozzle structures that may possibly be utilized or possibly adapted for use in at least one possible embodiment of the present application may possibly be found in the following U.S. Pat. No. 6,042,026 issued to Buehler, II on Mar. 28, 2000; U.S. Pat. No. 6,394,366 issued to Adams on May 28, 2002; U.S. Pat. No. 6,402,062 issued to Bendig et al. on Jun. 11, 2002; U.S. Pat. No. 6,616,072 issued to Harata et al. on Sep. 9, 2003; U.S. Pat. No. 6,666,386 issued to Huang on Dec. 23, 2003; and U.S. Pat. No. 6,681,498 issued to Steffan on Jan. 27, 2004.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

Some examples of pneumatic valves which may possibly be utilized or adapted for use in at least one possible embodiment may possibly be found in the following U.S. Pat. No. 6,772,791, entitled "Directly operated pneumatic valve having an air assist return;" U.S. Pat. No. 6,729,346, entitled "Pneumatic valve;" U.S. Pat. No. 6,676,107, entitled "Control element, especially a pneumatic valve;" U.S. Pat. No. 6,550,416, entitled "Pneumatic valve device;" U.S. Pat. No. 6,543,481, entitled "Pilot operated pneumatic valve;" U.S. Pat. No. 6,488,050, entitled "Pneumatic valve assembly;" U.S. Pat. No. 6,089,251, entitled "Pneumatic valve;" U.S. Pat. No. 4,526,341, entitled "Pneumatic shut-off valve;" U.S. Pat. No. 4,515,183, entitled "Pneumatic control valve;" and U.S. Pat. No. 4,480,663, entitled "Pneumatic relay valve."

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

Some examples of starwheels which may possibly be utilized or adapted for use in at least one possible embodiment may possibly be found in the following U.S. Pat. No. 5,613,593, entitled "Container handling starwheel;" U.S. Pat. No. 5,029,695, entitled "Improved starwheel;" U.S. Pat. No. 4,124,112, entitled "Odd-shaped container indexing starwheel;" and U.S. Pat. No. 4,084,686, entitled "Starwheel control in a system for conveying containers."

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72(b):

A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims. Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

AT LEAST PARTIAL LIST OF NOMENCLATURE

| | |
|---|---|
| 1 | Filling element |
| 2 | Rotor |
| 3 | Bottle |
| 3.1 | Bottle mouth |
| 4 | Ring bowl |
| 4.1 | Gas headspace in the ring bowl |
| 4.2 | Liquid space in the ring bowl |
| 5, 6, 7 | Ring duct |
| 8 | Housing of the filling element |
| 9 | Liquid duct in the filling element |
| 10 | Connecting duct |
| 11 | Centering bell |
| 12 | Dispensing opening |
| 13 | Liquid valve |
| 14 | Valve body |
| 15 | Tube |
| 16 | Chamber |
| 17 | Actuator element for liquid valve 13 |
| 18, 19, 20 | Valve for control of a gas path |
| 21 | Additional liquid valve |
| 22 | Duct |
| 22.1 | Duct segment |
| 23, 24, 25 | Gas duct |
| 26 | Container carrier |
| 27 | Inductive flowmeter |
| 28 | Jet of liquid being bottled |
| FA | Vertical filling element axis |
| N | Level |

What is claimed is:

1. A beverage bottling plant for filling beverage bottles with liquid beverage material, said beverage bottling plant comprising:

a beverage bottle cleaning machine being configured and disposed to clean beverage bottles;

a feed arrangement to supply beverage bottles to said beverage bottle cleaning machine;

a beverage filling machine being configured and disposed to fill beverage bottles with liquid beverage material;

said beverage filling machine comprising a plurality of beverage filling devices for filling beverage bottles with liquid beverage material;

at least one storage unit being configured and disposed to store a supply of liquid beverage material;

at least one supply line being configured and disposed to connect said at least one storage unit to said beverage filling machine to supply liquid beverage material to said beverage filling machine;

a first conveyer arrangement being configured and disposed to move beverage bottles from said beverage bottle cleaning machine into said beverage filling machine;

said first conveyer arrangement comprising a star wheel structure;

a beverage bottle closing machine being configured and disposed to close tops of filled beverage bottles;

a second conveyer arrangement being configured and disposed to move filled beverage bottles from said beverage filling machine into said beverage bottle closing machine;

said second conveyer arrangement comprising a star wheel structure;

a beverage bottle labeling machine being configured and disposed to label filled, closed beverage bottles;

a third conveyor arrangement being configured and disposed to move filled, closed beverage bottles from said beverage bottle closing machine into said beverage bottle labeling machine;

said third conveyer arrangement comprising a star wheel structure;

a beverage bottle packing station being configured and disposed to package labeled, filled, closed beverage bottles;

a fourth conveyor arrangement being configured and disposed to move labeled, filled, closed beverage bottles from said beverage bottle labeling machine to said beverage bottle packing station;

said fourth conveyer arrangement comprising a linear conveyor structure being configured and disposed to arrange beverage bottles in groups for packing;

said beverage filling machine comprising a rotor being configured and disposed to carry said plurality of filling devices about its periphery;

each of said filling devices comprising:

a dispensing opening being configured and disposed to permit the flow of liquid through said dispensing opening and into a bottle to be filled;

a liquid duct being configured and disposed to permit the flow of liquid from a liquid reservoir;

a housing being configured and disposed to house said liquid duct;

a first liquid valve being disposed in said liquid duct to control the flow of liquid to said dispensing opening;

a first valve actuating arrangement being configured and disposed to open and close said first liquid valve;

a tube comprising an open top end portion and an open bottom end portion;

said tube being configured and disposed to permit the flow of a liquid beverage into a bottle to be filled in an open-jet filling process;

said tube being configured and disposed to permit the flow of gas out of a bottle being filled in a bottle-contact filling process;

at least one gas valve being configured and disposed to be opened and closed with an actuating device and to control the flow of gas from said tube in a bottle-contact filling process;

at least one gas duct being configured and disposed to carry gas from said filling device in a bottle-contact filling process;

a second liquid valve being configured and disposed to be closed with an actuating device to stop a liquid beverage from flowing into said tube in a bottle-contact filling process; and said second liquid valve being configured and disposed to be opened with an actuating device to permit the flow of liquid beverage into said tube in an open-jet filling process.

2. The filling device for bottling a liquid in bottles or similar containers according to claim 1, with a liquid duct realized in a housing of the filling device, which liquid duct is in communication by means of an inlet with a reservoir or bowl for the liquid being bottled and forms a dispensing opening for the dispensing of the liquid into a container to be filled, with a first liquid valve with an associated actuator device located between the inlet and the dispensing opening in the liquid duct for the controlled opening and closing of the first liquid valve, with a tube which is open on both ends and is provided with a first open end in the vicinity of the dispensing opening, with a plurality of ducts that are realized in the housing of the filling device, and with control valves controlling said ducts, whereby to fill the respective container that is positioned in sealed contact with the filling device, at least one of the control valves controls a return gas duct that leads through the tube, wherein:

in addition to the first liquid valve, a control valve that functions as an additional liquid valve is provided, by means of which, for an open-jet filling of the respective container with its mouth at some distance from the filling device, the second end of the tube can be placed in communication in a controlled manner with the reservoir or bowl that contains the liquid to be bottled;

the control valve that forms said additional liquid valve is located in a connecting duct between the second end of the tube and a portion of the liquid duct that extends between the inlet for the liquid into the filling device and the first liquid valve;

the connecting duct is in communication on one end with the second end of the tube;

the connecting duct and the tube empty into a common chamber that is realized in the housing;

the at least one gas valve is located in a connection between a gas duct and a segment of the connecting duct that is in communication with the tube;

the tube is surrounded in a ring-like manner on its first end by the dispensing opening;

the tube projects out of the filling device beyond a contact surface that is formed on the dispensing opening for the mouth of the respective container;

the first liquid valve is formed by a valve body that is provided on the tube and interacts with a valve surface in the liquid duct, and that the tube can be moved over axially over a limited distance together with the valve body for the opening and closing of the first liquid valve by the actuator device of said valve;

at least three gas ducts realized in the housing, with respective gas valves that each control one of said ducts; and each of the gas ducts can be placed in communication in a controlled manner by means of their control valves with the segment of the connecting duct that is in communication with the one end of the tube.

3. A filling device for use in a beverage bottling plant, said filling device comprising:

a tube comprising an open top end portion and an open bottom end portion;

said tube being configured and disposed to permit the flow of a liquid beverage into a bottle in an open-jet filling process;

said tube being configured and disposed to permit gas to be evacuated from a bottle during a bottle-contact filling process;

liquid valving being configured and disposed to lead a liquid beverage into said open top end of said tube and to discharge a liquid beverage from said open bottom end of said tube during an open-jet filling process;

gas valving being configured and disposed to permit gas to be evacuated from a bottle via said tube in a bottle-contact filling process; and said liquid valving being configured and disposed to permit liquid to flow into a bottle during a bottle-contact filling process.

4. The filling device for bottling a liquid in bottles or similar containers according to claim 3, with a liquid duct realized in a housing of the filling device, which liquid duct is in communication by means of an inlet with a reservoir or bowl for the liquid being bottled and forms a dispensing opening for the dispensing of the liquid into a container to be filled, with a first liquid valve with an associated actuator device located between the inlet and the dispensing opening in the liquid duct for the controlled opening and closing of the first liquid valve, with a tube which is open on both ends and is provided with a first open end in the vicinity of the dispensing opening, with a plurality of ducts that are realized in the housing of the filling device, and with control valves controlling said ducts, whereby to fill the respective container that is positioned in sealed contact with the filling device, at least one of the control valves controls a return gas duct that leads through the tube, characterized by the fact that in addition to the first liquid valve, a control valve that functions as an additional liquid valve is provided, by means of which, for an open-jet filling of the respective container with its mouth at some distance from the filling device, the second end of the tube can be placed in communication in a controlled manner with the reservoir or bowl that contains the liquid to be bottled.

5. The filling device as claimed in claim 4, characterized by the fact that the control valve that forms said additional liquid valve is located in a connecting duct between the second end of the tube and a portion of the liquid duct that extends between the inlet for the liquid into the filling device and the first liquid valve.

6. The filling device as claimed in claim 5, characterized by the fact that the connecting duct is in communication on one end with the second end of the tube.

7. The filling device as claimed in claim 6, characterized by the fact that the connecting duct and the tube empty into a common chamber that is realized in the housing.

8. The filling device according to claim 7, characterized by the fact that the at least one gas valve is located in a connection between a gas duct and a segment of the connecting duct that is in communication with the tube.

9. The filling device according to claim 8, characterized by the fact that the tube is surrounded in a ring-like manner on its first end by the dispensing opening.

10. The filling device according to claim 9, characterized by the fact that the tube projects out of the filling device beyond a contact surface that is formed on the dispensing opening for the mouth of the respective container.

11. The filling device according to claim 10, characterized by the fact that the first liquid valve is formed by a valve body that is provided on the tube and interacts with a valve surface in the liquid duct, and that the tube can be moved over axially over a limited distance together with the valve body for the opening and closing of the first liquid valve by the actuator device of said valve.

12. The filling device according to claim 11, characterized by at least three gas ducts realized in the housing, with respective gas valves that each control one of said ducts; and characterized by the fact that each of the gas ducts can be placed in communication in a controlled manner by means of their control valves with the segment of the connecting duct that is in communication with the one end of the tube.

13. A method of filling bottles with a liquid beverage with a filling device, said filling device comprising:

a tube comprising an open top end portion and an open bottom end portion;

said tube being configured and disposed to permit the flow of a liquid beverage into a bottle in an open-jet filling process;

said tube being configured and disposed to permit gas to be evacuated from a bottle during a bottle-contact filling process;

liquid valving being configured and disposed to lead a liquid beverage into said open top end of said tube and to discharge a liquid beverage from said open bottom end of said tube during an open-jet filling process;

gas valving being configured and disposed to permit gas to be evacuated from a bottle via said tube in a bottle-contact filling process; and liquid valving being configured and disposed to permit liquid to flow into a bottle during a bottle-contact filling process said method comprising the steps of:

operating said liquid valving to permit a liquid beverage to flow through said tube;

leading a liquid beverage down said tube and into a bottle in an open-jet filling process;

evacuating gas from a bottle being filled through said tube during a bottle-contact filling process;

operating said gas valving to permit gas to be evacuated from said filling device; and permitting liquid to flow through said valving to fill a bottle in a bottle-contact filling process.

14. The method of filling bottles with a liquid beverage with a filling device according to claim 13, said filling device comprising a liquid duct realized in a housing of the filling device, which liquid duct is in communication by means of an inlet with a reservoir or bowl for the liquid being bottled and forms a dispensing opening for the dispensing of the liquid into a container to be filled, with a first liquid valve with an associated actuator device located between the inlet and the dispensing opening in the liquid duct for the controlled opening and closing of the first liquid valve, with a tube which is open on both ends and is provided with a first open end in the vicinity of the dispensing opening, with a plurality of ducts that are realized in the housing of the filling device, and with control valves controlling said ducts, whereby to fill the respective container that is positioned in sealed contact with the filling device, at least one of the control valves controls a return gas duct that leads through the tube, characterized by the fact that in addition to the first liquid valve, a control valve that functions as an additional liquid valve is provided, by means of which, for an open-jet filling of the respective container with its mouth at some distance from the filling device, the second end of the tube can be placed in communication in a controlled manner with the reservoir or bowl that contains the liquid to be bottled.

15. The method of filling bottles with a liquid beverage with a filling device according to claim 14, said filling device comprising a control valve that forms said additional liquid valve is located in a connecting duct between the second end of the tube and a portion of the liquid duct that extends between the inlet for the liquid into the filling device and the first liquid valve.

16. The method of filling bottles with a liquid beverage with a filling device according to claim 15, said filling device being characterized by the fact that the connecting duct is in communication on one end with the second end of the tube.

17. The method of filling bottles with a liquid beverage with a filling device according to claim 16, said filling device being characterized by the fact that the connecting duct and the tube empty into a common chamber that is realized in the housing.

18. The method of filling bottles with a liquid beverage with a filling device according to claim 17, said filling device being characterized by the fact that the at least one gas valve is located in a connection between a gas duct and a segment of the connecting duct that is in communication with the tube.

19. The method of filling bottles with a liquid beverage with a filling device according to claim 18, said filling device being characterized by the fact that the tube is surrounded in a ring-like manner on its first end by the dispensing opening.

20. The method of filling bottles with a liquid beverage with a filling device according to claim 19, said filling device being characterized by:

the fact that the tube projects out of the filling device beyond a contact surface that is formed on the dispensing opening for the mouth of the respective container;

the fact that the first liquid valve is formed by a valve body that is provided on the tube and interacts with a valve surface in the liquid duct, and that the tube can be moved over axially over a limited distance together with the valve body for the opening and closing of the first liquid valve by the actuator device of said valve;

at least three gas ducts realized in the housing, with respective gas valves that each control one of said ducts; and the fact that each of the gas ducts can be placed in communication in a controlled manner by means of their control valves with the segment of the connecting duct that is in communication with the one end of the tube.

* * * * *